US011274802B2

(12) United States Patent
Dressler

(10) Patent No.: US 11,274,802 B2
(45) Date of Patent: Mar. 15, 2022

(54) PROJECTION HEADLIGHT

(71) Applicant: HELLA GMBH & CO. KGAA, Lippstadt (DE)

(72) Inventor: Björn Dressler, Menden (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/089,675

(22) Filed: Nov. 4, 2020

(65) Prior Publication Data

US 2021/0080072 A1 Mar. 18, 2021

Related U.S. Application Data

(63) Continuation of application No. PCT/EP2019/060318, filed on Apr. 23, 2019.

(30) Foreign Application Priority Data

May 4, 2018 (DE) ..... 10 2018 110 793.5

(51) Int. Cl.
*F21S 41/24* (2018.01)
*F21S 41/143* (2018.01)
*F21S 41/43* (2018.01)

(52) U.S. Cl.
CPC ..... *F21S 41/24* (2018.01); *F21S 41/143* (2018.01); *F21S 41/43* (2018.01)

(58) Field of Classification Search
CPC ..... F21S 41/40; F21S 41/43; F21S 41/265
See application file for complete search history.

(56) References Cited

U.S. PATENT DOCUMENTS 7,114,837 B2 10/2006 Yagi et al.
7,156,544 B2 1/2007 Ishida
9,243,771 B2 1/2016 Jungwirth et al.
(Continued)

FOREIGN PATENT DOCUMENTS

AT 511760 A1 2/2013
DE 102004017454 A1 1/2005
(Continued)

OTHER PUBLICATIONS

International Search Report dated Jul. 29, 2019 in corresponding application PCT/EP2019/060318.

*Primary Examiner* — Matthew J. Peerce
(74) *Attorney, Agent, or Firm* — Muncy, Geissler, Olds & Lowe, P.C.

(57) ABSTRACT

A projection headlight for vehicles having a first light module containing a light source and a primary optical system for shaping the light emitted by the light source, a second light module containing a light source and a primary optical system for shaping the light emitted by the light source, a secondary optical system, for projecting the light emerging from the primary optical system of the first light module in a region in front of the vehicle as a first light distribution and the light emerging from the primary optical system of the second light module as a second light distribution, a shield with a shield edge for producing a light/dark boundary in the resultant light distribution, wherein the primary optical systems of the first light module and of the second light module and the shield are connected to one another as a single piece.

7 Claims, 6 Drawing Sheets

(56) References Cited

U.S. PATENT DOCUMENTS

| | | | | |
|---|---|---|---|---|
| 10,082,272 | B2 | 9/2018 | Gromfeld | |
| 10,344,949 | B2 | 7/2019 | Gromfeld | |
| 11,060,685 | B2 * | 7/2021 | Schadenhofer | F21S 41/43 |
| 2009/0290372 | A1 | 11/2009 | Kotajima et al. | |
| 2016/0265733 | A1 * | 9/2016 | Bauer | F21S 41/20 |

FOREIGN PATENT DOCUMENTS

| | | | |
|---|---|---|---|
| DE | 102007052696 | A1 | 7/2008 |
| DE | 102015224745 | B4 | 11/2017 |
| EP | 2034235 | A1 | 3/2009 |
| EP | 2390561 | B1 | 1/2018 |
| EP | 3299703 | A1 | 3/2018 |
| FR | 2860280 | A1 | 4/2005 |
| WO | WO2016/162921 | A1 | 10/2016 |

* cited by examiner

PROJECTION HEADLIGHT

This nonprovisional application is a continuation of International Application No. PCT/EP2019/060318, which was filed on Apr. 23, 2019, and which claims priority to German Patent Application No. 10 2018 110 793.5, which was filed in Germany on May 4, 2018, and which are both herein incorporated by reference.

BACKGROUND OF THE INVENTION

Field of the Invention

The present invention relates to a projection headlight for vehicles having a first light module containing a light source and a primary optical system for shaping the light emitted by the light source, a second light module containing a light source and a primary optical system for shaping the light emitted by the light source, a secondary optical system for projecting the light emerging from the primary optical system of the first light module in a region in front of the vehicle as a first light distribution and the light emerging from the primary optical system of the second light module as a second light distribution, and a shield with a shield edge for producing a light/dark boundary in the resultant light distribution, wherein the primary optical systems of the first light module and of the second light module and the shield are connected to one another as a single piece.

Description of the Background Art

From EP 2 390 561 B1 and from DE 10 2015 224 745 B4, a projection headlight for vehicles is known that has a first light module with a light source and a primary optical system for producing a first light distribution and a second light module with a light source and a primary optical system for producing a second light distribution. A common secondary optical system, which is implemented as a lens, is provided in front of the light modules in the principal direction of emission of the headlight. In addition, a shield is associated with the first light module so that the light emerging from the primary optical system of the first light module can be projected by means of the secondary optical system into a low beam light distribution with a light/dark boundary. The second light module is additionally switched on when a high beam light distribution is to be produced as the resultant light distribution. A disadvantage of the known projection headlights is that the primary optical systems of the light modules are implemented as separate components. As a result, manufacturing and assembly tolerances must be compensated.

Known from EP 2 034 235 A1 is a projection headlight for vehicles that has a first light module with a light source and a primary optical system and a second light module with a light source and a primary optical system, with the same lens associated with each of these as a secondary optical system. The primary optical systems of the first and second light modules are connected to one another as a single piece, wherein a shield in a connection region of the same extends forward in the principal direction of emission. A front boundary of this shield serves to project a light/dark boundary of a light distribution when only the first light module is activated. If both the first light module and the second light module are activated, then a high beam light distribution is projected as the resultant light distribution. As primary optical systems, reflectors are provided, which must deflect the light of the light sources oriented transversely to a principal direction of emission of the projection headlight. Thus, indirect light deflection by the reflectors is involved. A disadvantage of the known projection headlight is that only a limited luminous flux can be used because of the indirect light deflection.

SUMMARY OF THE INVENTION

It is therefore an object of the present invention to provide a projection headlight for vehicles such that manufacturing as well as assembly tolerances can be kept as small as possible or avoided entirely in a simple manner with the highest possible utilization of the luminous flux emitted by the light sources.

In an exemplary embodiment, the first light module and the second light module have parallel optical axes arranged at an offset to one another, and each light module has a separate secondary optical system.

At least two light modules can be provided that each have at least one separate primary optical system and a separate secondary optical system. Optical axes of the primary optical system and the secondary optical system of the same light module are arranged in a line or, in the case of multiple primary optical systems, are parallel to one another. Both the light source and the primary and secondary optical systems are substantially rotationally symmetrical, and preferably are arranged to be rotationally symmetrical to the optical axis of the relevant light module. Advantageously, the primary optical systems or secondary optical systems of the light modules can be modular in arrangement, wherein the primary optical systems of the light modules are connected to one another as a single piece. In addition, shields can be integrated into the primary optical component through a one-piece extension protruding forward in the principal direction of emission. As a result, it is possible to provide high-intensity light modules with the greatest possible avoidance of manufacturing and assembly tolerances.

The primary optical systems of the light modules and the shield can be designed such that they can be manufactured by injection molding in a single mold. Advantageously, the manufacturing and assembly tolerances that are otherwise present in multi-piece designs can be avoided by single-piece manufacture of the primary optical systems and the shield. The mold need only be designed such that the photometric deviations range within the legal requirements.

The primary optical systems of the light modules and the shield can be molded in such a manner that they can be demolded in a single demolding direction. Advantageously, manufacturing costs can be reduced by this means.

The primary optical systems can be implemented as a light guide with a light input surface and with a light output surface arranged at the front in the principal direction of emission. A pre-shaping of the light can thus take place effectively, wherein the light emerging from the primary optical system can be projected in a region in front of the vehicle corresponding to the specified light distribution by the respective secondary optical systems, preferably implemented as a lens, of the same light module.

The first light module can be implemented as a basic light module for producing a symmetrical basic light distribution below a horizontal zero line. The second light module is implemented as a long-range light module for producing a long-range light distribution with light components above and below the horizontal zero line. A desired low beam light distribution can be produced by superimposing the basic light distribution and the long-range light distribution.

The long-range light module can have, in addition to a long-range primary optical system, an auxiliary primary optical system for producing a high beam light distribution. In a space-saving manner, the auxiliary primary optical system can be arranged below the long-range primary optical system.

An upper boundary of a light output surface of the auxiliary primary optical system can constitute a shield edge, which is struck by the light emerging from the long-range primary optical system. The shield edge is projected into a light/dark boundary of the long-range light module by means of the secondary optical system. By additionally switching on the light source associated with the auxiliary primary optical system, a high beam light distribution can thus be produced in a simple manner through superimposition.

A surface of the shield may only be partially or may be completely coated with a reflective material. In this way, the light/dark boundary in the low beam light distribution can be projected more sharply. A further advantage of this coating is that the light rays coupled out of the primary optical systems cannot be coupled into the auxiliary primary optical system. The efficiency of the system increases as a result.

The secondary optical systems of the light modules associated in each case with the primary optical systems can be connected to one another as a single piece. Advantageously, only the secondary optical system of one of the light modules need be aligned with the corresponding primary optical system. With correct alignment, the other light modules are adjusted at the same time during installation.

The light sources can be arranged to be oriented in the principal direction of emission of the projection headlight. Preferably, the light sources are arranged on a common printed circuit board so that the manufacturing costs can be reduced further.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

A projection headlight for vehicles, in particular for motor vehicles, has a primary optical component 1 and a secondary optical component 2, which are arranged inside a housing. The housing has, arranged at the front in the principal direction of emission H, an opening that is closed by a transparent cover plate.

The primary optical component 1 and the secondary optical component 2 are each elongated in design. Retaining elements 3 for mounting the primary optical component 1 in the housing are arranged on the end faces of the primary optical component.

Figure 8:
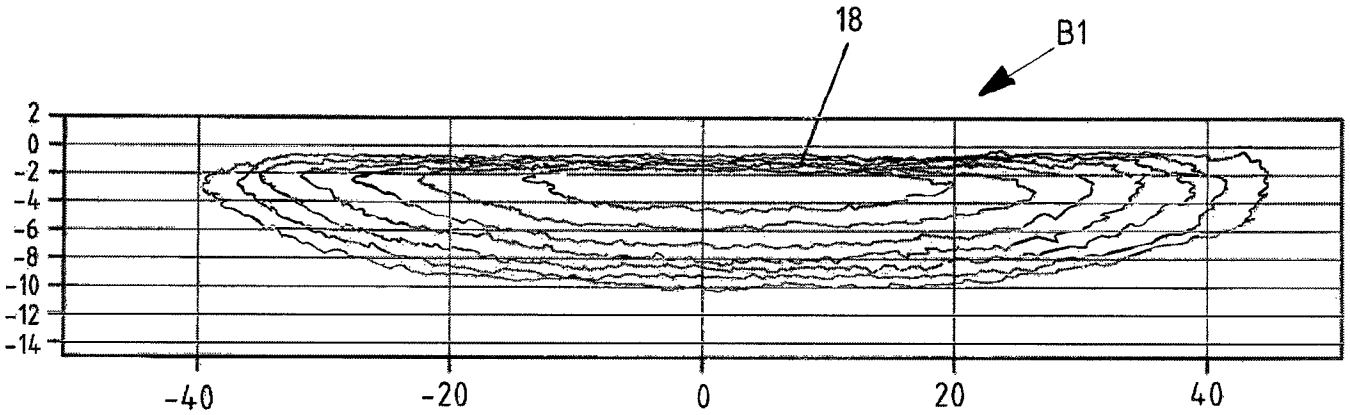
FIG. 8 shows a light distribution of the basic light modules.
Figure 9:
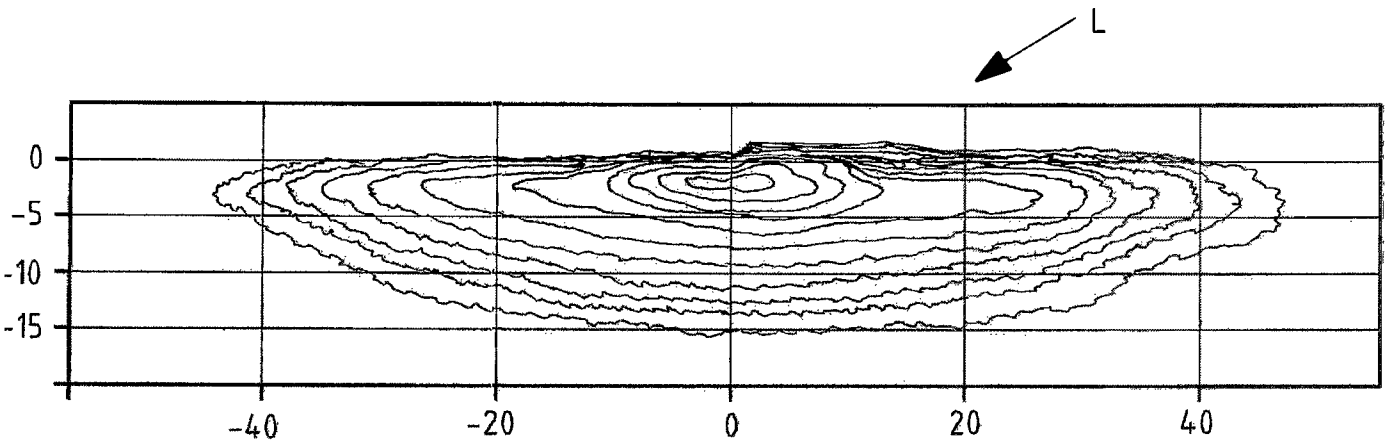
FIG. 9 shows a resultant light distribution of the long-range and basic light modules.

The primary optical component 1 has a multiplicity of primary optical systems P1, P2, P3, P4, P5 arranged in a straight line. The secondary optical component 2 has a number of secondary optical systems S1, S2, S3, S4, S5 arranged in a straight line. There are thus five light modules in the present exemplary embodiment, wherein two identical basic light modules 4 are provided as a first light module 4, which each have the same primary optical system P1, P2 and the same secondary optical system S1, S2. The identically designed primary optical systems P1 and P2 and the relevant identically designed secondary optical systems S1 and S2 are designed such that a relatively wide basic light distribution B1 below a horizontal zero line is produced as the first light distribution, see FIG. 8.

Figure 7:
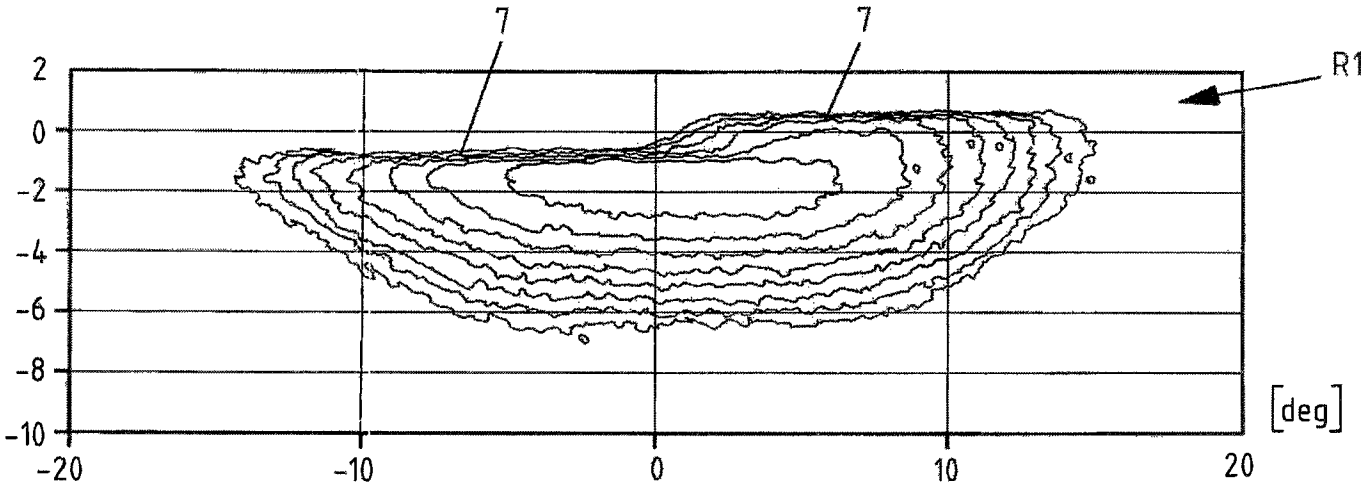
FIG. 7 shows a light distribution of another long-range light module.

Three long-range light modules are provided as second light modules 5, 6, wherein one long-range light module 5 has a primary optical system P3 and a secondary optical system S3, by means of which a long-range light distribution R1 as shown in FIG. 7 can be produced as the second light distribution. This long-range light distribution R1 includes a light component below the horizontal zero line and a light component above the horizontal zero line with an asymmetrical light/dark boundary 7.

Figure 6:
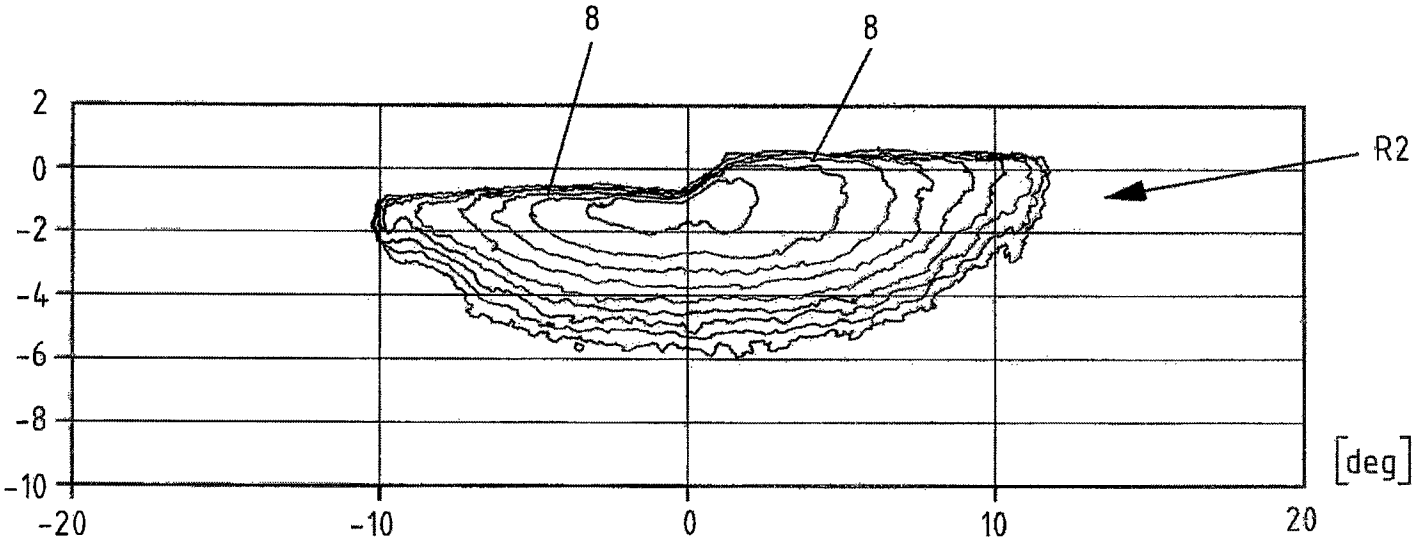
FIG. 6 shows a light distribution of two identical long-range light modules.

Two identical light modules are provided as the additional long-range light module 6, wherein one second light module 6 has a primary optical system P4 and a secondary optical system S4, and the other second light module 6 has a primary optical system P5 and a secondary optical system S5. These primary optical systems P4 or P5 and secondary optical systems S4 and S5 are designed such that long-range light distributions R2 as shown in FIG. 6 can be produced. These light distributions have an asymmetrical light/dark boundary 8. In comparison with the second light modules 6, the second light module 5 is designed such that the long-range light distribution R1 illuminates a wider region in front of the vehicle in the horizontal direction than the long-range light distribution R2.

Figure 10:
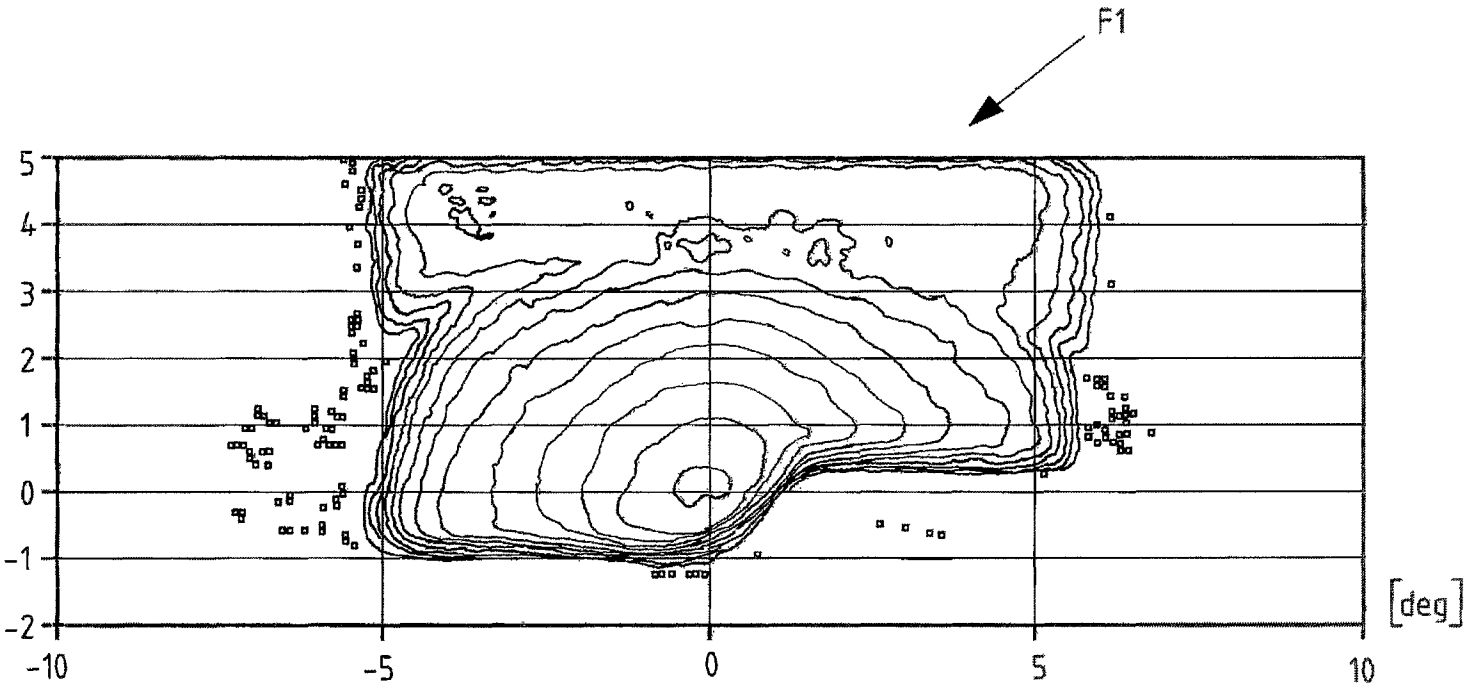
FIG. 10 shows a light distribution of the long-range light module with an auxiliary primary optical system, wherein solely the light source associated with the auxiliary primary optical system is switched on to produce a high beam light distribution.

The long-range light modules 6 have multiple primary optical systems, namely a long-range primary optical system P4, P5, by means of which the long-range light distribution R2 as shown in FIG. 6 can be produced. In addition, the light modules 6 have an auxiliary primary optical system P6, by means of which a high beam light distribution F1 as shown in FIG. 10 can be produced.

Figure 1:
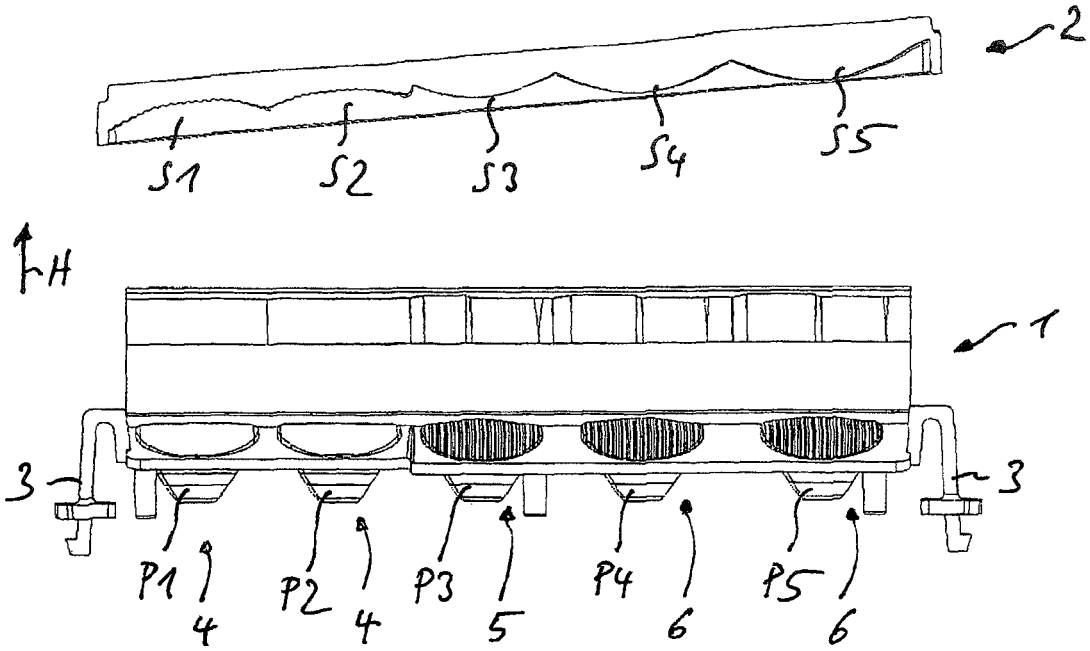
FIG. 1 is a top view of a projection headlight according to the invention, wherein three long-range light modules and two basic light modules are provided.
Figure 2:
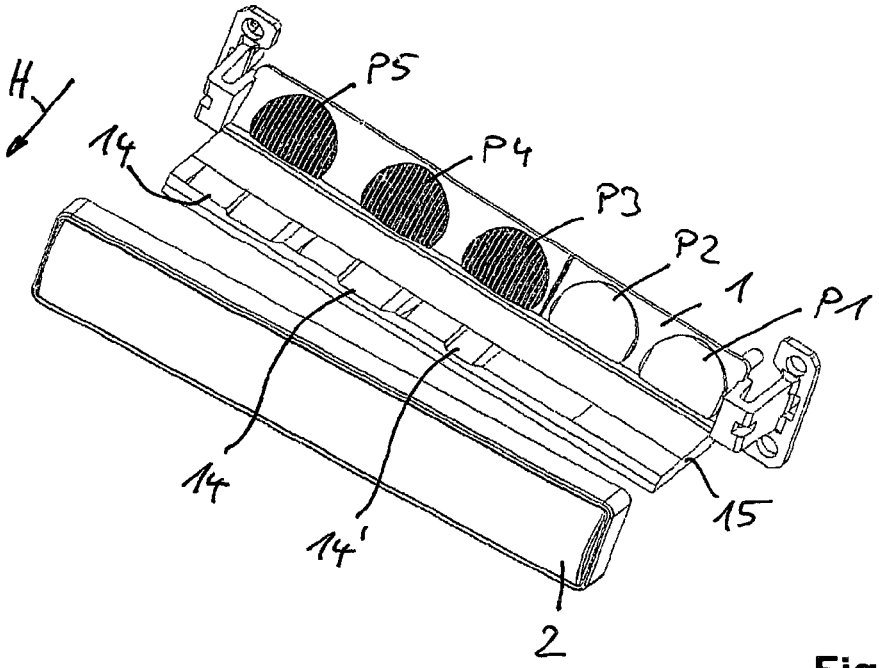
FIG. 2 is a perspective front view of the projection headlight.
Figure 3:
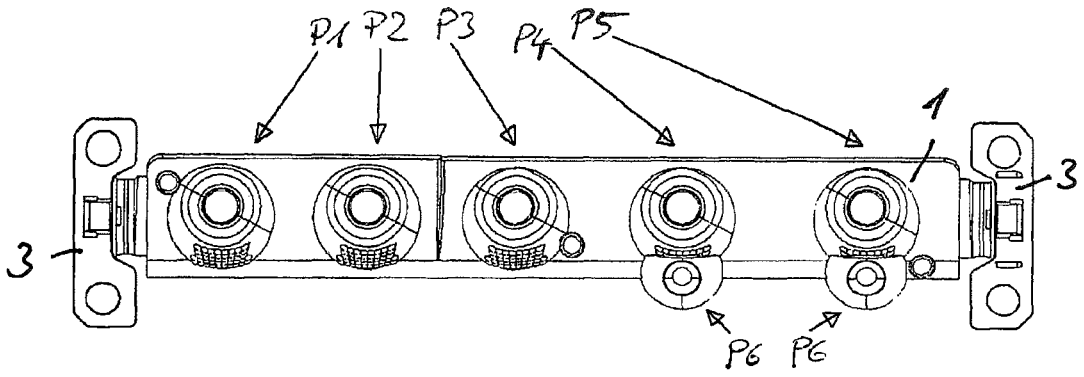
FIG. 3 is a rear view of the projection headlight.

Associated with each of the primary optical systems P1, P2, P3, P4, P5, P6 is a light source 9 whose optical axis A1, A2 extends in the principal direction of emission H. The axes A1, A2 of the light sources 9 of the light modules are parallel to and offset from an optical axis 16 of the same light module. The optical axis 16 of the secondary optical system runs centrally through the secondary optical system of the same light module 4, 5, 6. As is evident from FIG. 1, the optical axes 16 of the respective light modules 4, 5, 6 are arranged parallel to and at an offset from one another. The secondary optical systems S1, S2, S3, S4, S5 can, for example, be in a swept arrangement, which is to say not perpendicular but instead at an acute angle to the principal direction of emission H. The light sources 9 of the light modules 4, 5, 6 are preferably arranged on one common printed circuit board 10 (rigid printed circuit board).

The primary optical elements P1, P2, P3, P4, P5, P6 are each implemented as light guides that have a light input surface 11 and, on a front side in the principal direction of emission H, a light output surface 12 or 13. Extending between the light input surface 11 and the light output surface 12 is a lateral surface, at which light that is coupled in is totally reflected.

As is evident from FIG. 5, the primary optical system P6 directly adjoins the primary optical system P4 or P5 from below, wherein the primary optical system P6 has a length $I_F$ that is greater than a length $I_R$ of the primary optical systems P4, P5. An upper boundary of the light output surface 13 of the auxiliary primary optical system P6 constitutes a shield edge 14 of a shield of the long-range light modules 6. This shield edge 14 is projected to the light/dark boundary 8 of the long-range light modules 6 by the secondary optical systems S4 or S5.

Figure 5:
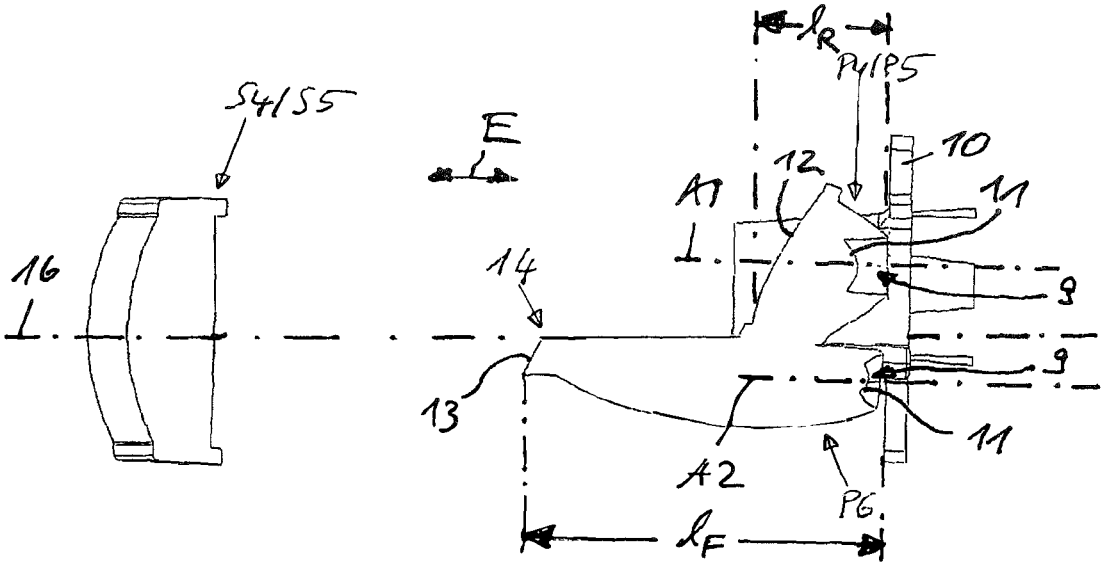
FIG. 5 shows a vertical section through a second light module with a long-range primary optical system and an auxiliary primary optical system and a common secondary optical system.

The surface of the shield formed between the shield edge 14 and the light output surface 12 in FIG. 5 is coated only partially or completely with a reflective material, for example is vapor-deposited with a reflective material, so that the shield edge 14, 14', 14" is projected sharply as the light/dark boundary 7, 8, 18.

Figure 4:
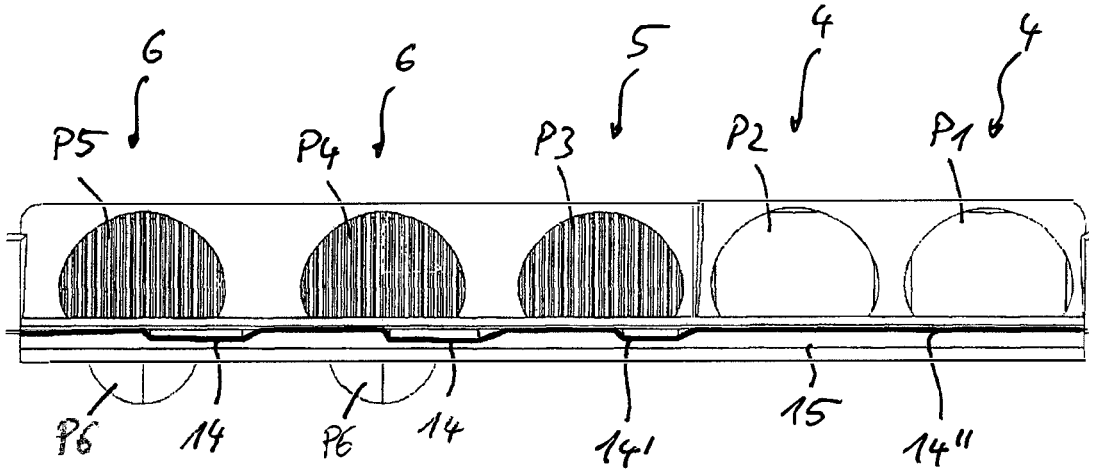
FIG. 4 is a front view of the projection optical systems of the projection headlight.

As is evident from FIG. 4, the shield edges 14 of the second light modules 6 are shaped identically, each designed with a slant. A shield edge 14' of the second light module 5 has a different contour, likewise provided with a slant. A shield edge 14" of the first light module 4 has a continuous straight contour so that a horizontal light/dark boundary 18 is produced in the basic light distribution B1 instead of the asymmetrical light/dark boundary 7 or 8 in the long-range light distributions R1, R2.

The shield edges 14, 14' each run in a front end region of an extension 15 that extends forward in the principal direction of emission H in a lower region of the primary optical systems P1, P2, P3, P4, P5. The auxiliary primary optical systems P6 of the light modules 6 run below the extension 15.

As is evident from FIG. 5, in particular, the primary optical systems P1, P2, P3, P4, P5, P6 and the secondary optical systems S1, S2, S3, S4, S5 are designed such that the primary optical component 1 and the secondary optical component 2 can each be manufactured by injection molding in a separate mold, and each can be manufactured with a single mold and can be demolded in a single demolding direction.

The primary optical systems P1, P2, P3, P4, P5, P6 are connected to one another as a single piece. Furthermore, the secondary optical systems S1, S2, S3, S4, S5 are connected to one another as a single piece. The secondary optical systems S1, S2, S3, S4, S5 are each implemented as lens elements.

The light sources 9 preferably are implemented as LED light sources.

According to an alternative embodiment of the invention that is not shown, the primary optical systems P1, P2, P3, P4, P5, P6 or secondary optical systems S1, S2, S3, S4, S5 can also be arranged along a curved line or can be adapted to the shape of the housing.

To produce a low beam light distribution, the light sources 9 associated with the first light modules 4 on the one hand and the light sources 9 associated with the second light modules 5 and/or 6 on the other hand are switched on. A resultant light distribution L consequently occurs as a superimposition of the light distributions B1 and R1 and/or R2.

To produce a high beam light distribution F1, the light sources 9 associated with the auxiliary primary optical systems P6 are additionally switched on so that the high beam light distribution is produced through superimposition of the light distributions L and the light distribution F1.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A projection headlight for a vehicle, the projection headlight comprising:

a first light module having a first light source and a first primary optical system for shaping light emitted by the first light source;

a second light module having a second light source and a second primary optical system for shaping light emitted by the second light source;

a first secondary optical system to project the light emerging from the first primary optical system of the first light module in a region in front of the vehicle as a first light distribution and a second secondary optical system to project the light emerging from the second primary optical system of the second light module as a second light distribution; and a shield with a shield edge to produce a light/dark boundary in the resultant light distribution, wherein the first primary optical system of the first light module, the second primary optical system of the second light module and the shield are connected to one another as a single piece, wherein the first light module and the second light module have parallel optical axes arranged at an offset to one another, wherein the first light module is configured as a basic light module, wherein the first light distribution is configured as a symmetrical basic light distribution below a horizontal zero line, wherein the second light module is configured as a long-range light module, wherein the second light distribution is configured as a long-range light distribution with light components above and below the horizontal zero line, and wherein the long-range light module has the second primary optical system for producing the long-range light distribution as an asymmetrical long-range light distribution, and the long-range light module also has an auxiliary primary optical system with an auxiliary light source for producing a high beam light distribution, wherein a length between a light input surface and a light output surface of the auxiliary primary optical system is greater, in a direction of the optical axis, than a length between a light input surface and a light output surface of the second primary optical system.

2. The projection headlight according to claim 1, wherein the first primary optical system of the first light module, the second primary optical system of the second light module and the shield are connected to one another as the single piece by injection molding in a single mold, such that the first primary optical system, the second primary optical system and the shield are monolithic.

3. The projection headlight according to claim 1, wherein the first primary optical system is a light guide with a light input surface and with a light output surface arranged at a front in a principal direction of emission.

4. The projection headlight according to claim 1, wherein the shield is arranged at a front end of the auxiliary primary optical system, wherein one shield edge constitutes an upper boundary of a light output surface of the auxiliary primary optical system.

5. The projection headlight according to claim 1, wherein at least one surface of the shield is coated with a reflective material, and wherein the reflective material only partially covers the at least one surface or completely covers an entirety of the at least one surface of the shield.

6. The projection headlight according to claim 1, wherein the first secondary optical system and the second secondary optical system are connected to one another as a single piece.

7. The projection headlight according to claim 1, wherein the first light source and the second light source are arranged to be oriented in the principal direction of emission.

* * * * *